US006213223B1

(12) United States Patent
Huhdanmäki

(10) Patent No.: US 6,213,223 B1
(45) Date of Patent: Apr. 10, 2001

(54) ARRANGEMENT FOR SUPPORTING ROCK DRILLING APPARATUS

(75) Inventor: Tapani Huhdanmäki, Tampere (FI)

(73) Assignee: Sandvick Tamrock Oy, Tampere (FI)

( * ) Notice: Subject to any disclaimer, the term of this patent is extended or adjusted under 35 U.S.C. 154(b) by 0 days.

(21) Appl. No.: 09/308,360

(22) PCT Filed: Nov. 26, 1997

(86) PCT No.: PCT/FI97/00725

§ 371 Date: May 18, 1999

§ 102(e) Date: May 18, 1999

(87) PCT Pub. No.: WO98/23847

PCT Pub. Date: Jun. 4, 1998

(30) Foreign Application Priority Data

Nov. 27, 1996 (FI) ..... 964737

(51) Int. Cl.[7] ..... B23Q 5/00

(52) U.S. Cl. ..... 173/4; 173/1; 173/2; 173/32; 173/34; 173/36

(58) Field of Search ..... 173/4, 2, 1, 11, 173/32, 34, 37, 36; 175/27

(56) References Cited

U.S. PATENT DOCUMENTS

| | | | | |
|---|---|---|---|---|
| 2,979,320 | * | 4/1961 | Adams | 173/34 |
| 3,106,257 | * | 10/1963 | Helm | 173/34 |
| 3,721,094 | * | 3/1973 | Elders et al. | 173/34 |
| 3,951,216 | | 4/1976 | Crawshay et al. | 173/32 |
| 4,109,733 | * | 8/1978 | Dummer | 173/4 |
| 4,537,263 | * | 8/1985 | Bjor | 173/11 |
| 4,676,322 | * | 6/1987 | Rajakallio et al. | 173/32 |
| 4,848,485 | * | 7/1989 | Piipponen et al. | 173/4 |
| 5,129,464 | | 7/1992 | Richier | 173/32 |
| 5,131,475 | * | 7/1992 | Beney | 173/4 |

* cited by examiner

*Primary Examiner*—Peter Vo
*Assistant Examiner*—Jim Calve
(74) *Attorney, Agent, or Firm*—Smith-Hill and Bedell

(57) ABSTRACT

An arrangement in a rock drilling apparatus comprising supports (5) directed toward the rear part of the feed, the supports being moveable by means of support cylinders (6) to support the feed during the drilling operation. The arrangement comprises a pressure detector (9), which is arranged to detect the pressure of the pressure fluid in the support cylinders (6) and to make the control unit supply more pressure fluid to the support cylinders (6) when the pressure drops below a pre-set threshold value.

3 Claims, 2 Drawing Sheets

ARRANGEMENT FOR SUPPORTING ROCK DRILLING APPARATUS

BACKGROUND OF THE INVENTION

The invention relates to an arrangement in a rock drilling apparatus comprising a feed for feeding a rock drill during the drilling; at least one rear support connected to the feed substantially parallel to and rearward of the feed, the support being moveable by its own support cylinder to rest on a surface rearward of the feed; and means for supplying pressure fluid to the support cylinder.

When holes are drilled in rock, the drill apparatus is usually supported by hydraulically-driven supports at its front and/or rear end. When the drill apparatus is directed, it is first adjusted in the correct direction, and the supports are then moved outward at the end of the drill apparatus by hydraulic cylinders until the supports rest against a surface in that direction. This is usually done before the drilling is started, and the bracing is usually not corrected in any way. During the drilling both the vibration and the feed capacity of the rock drill typically make the supports sink in the support surface, for example as the chippings in the surface yield. As a result, the direction of the drill apparatus changes and has to be corrected, which is at present usually performed by different angle gauges and very often by automatic adjustment.

In extension rod drilling, it is of prime importance to keep the direction during the drilling. Even a minor lateral change or change of angle to the effect that the drill axis of the drill apparatus and the centre axis of the hole do not coincide causes problems, for example, as regards disassembly of the drill equipment, since the threaded joints of drill pipes then no longer open in the correct order. A directing error of even half a degree is known to hinder automatic disassembly of the drill equipment. Another drawback resulting from the known methods of adjustment is that the drill apparatus, although in correct direction, is displaced laterally from the axis of the drill hole, which causes similar problems.

U.S. Pat. No. 5,129,464 teaches a solution in which the anchoring force of the feed of a rock drilling apparatus against a rock surface is to be maintained constant by adjusting the force that pushes the feed in proportion to the feed force of the rock drill in such a way that the difference of the forces and thereby the anchoring force remain constant. The solution does in no way eliminate the above problem concerning the changing of the direction and the resulting change of direction or lateral displacement that make it more difficult to disengage the drill rods.

BRIEF SUMMARY OF THE INVENTION

The object of the present invention is to provide an arrangement for a rock drilling apparatus by which the above drawbacks can be eliminated and the drilling and the disassembly of the extension rod equipment can be performed simply and correctly.

The arrangement of the invention is characterized by comprising means for setting the pressure value of the pressure fluid in the support cylinder; a pressure detector for detecting the pressure of the support cylinder; and a control unit, controlled by the pressure detector, for controlling the supply of the pressure fluid to the support cylinder so as to maintain the pressure in the support cylinder during the drilling at substantially a pre-set pressure value.

The essential idea of the invention is that one or more rear supports are driven into the support surface before the drilling starts by supplying pressure fluid to the support cylinders, and that the pressure detector detects the pressure prevailing in the support cylinder, and the control unit controls the supply of the pressure fluid to the support cylinder or cylinders so as to maintain the pressure substantially at the set value. The supports press firmly against the support surface even before the drilling operation is started and, if the support surface yields so that the support is pushed outward in the support cylinder and the pressure subsequently tends to drop below the set pressure level, then more pressure fluid is supplied to the cylinder to maintain the pressure level substantially constant. The bracing compensates for any yielding of the ground and maintains the feed direction of the rock drilling apparatus with a sufficient accuracy as originally set. Experiments have shown that in this way the direction can be maintained the same with the accuracy of about 0.1°, and so the above problems relating to stress in the equipment and to unthreading in the disassembly step can be eliminated. A lateral displacement between the drill axis of the rock drilling apparatus and the longitudinal axis of the hole can be simultaneously avoided.

The advantage of the invention is that the drilling direction and the position of the drill apparatus can be maintained substantially unchanged in a simple and effective manner without any extra changes of angle, and without any extra equipment for angle measurement and automatic adjustment. A further advantage is that in most cases it is possible avoid the use of extra front supports and the drilling can be performed merely on the rear supports, using two rear supports spaced from each other.

BRIEF DESCRIPTION OF THE DRAWINGS

The invention will be described in greater detail in the attached drawings, in which.

DETAILED DESCRIPTION OF THE INVENTION

Figure 1A:
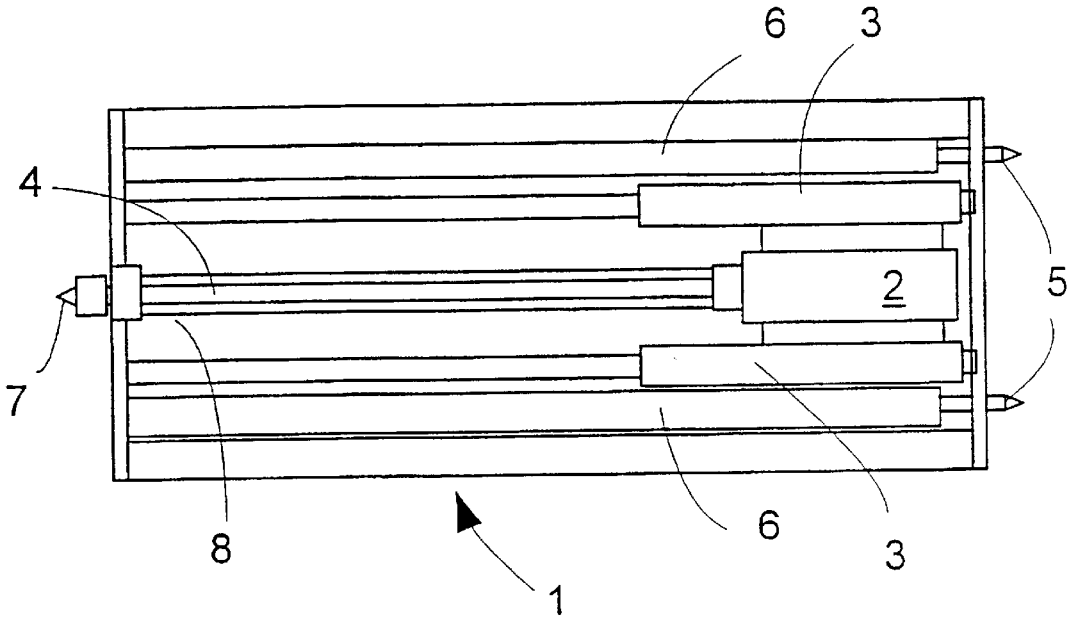
FIGS. 1*a* and 1*b* show a schematic general view of an arrangement according to the invention arranged in a feed of a rock drilling apparatus, the feed being shown as a top view and a side view, respectively.
Figure 1B:
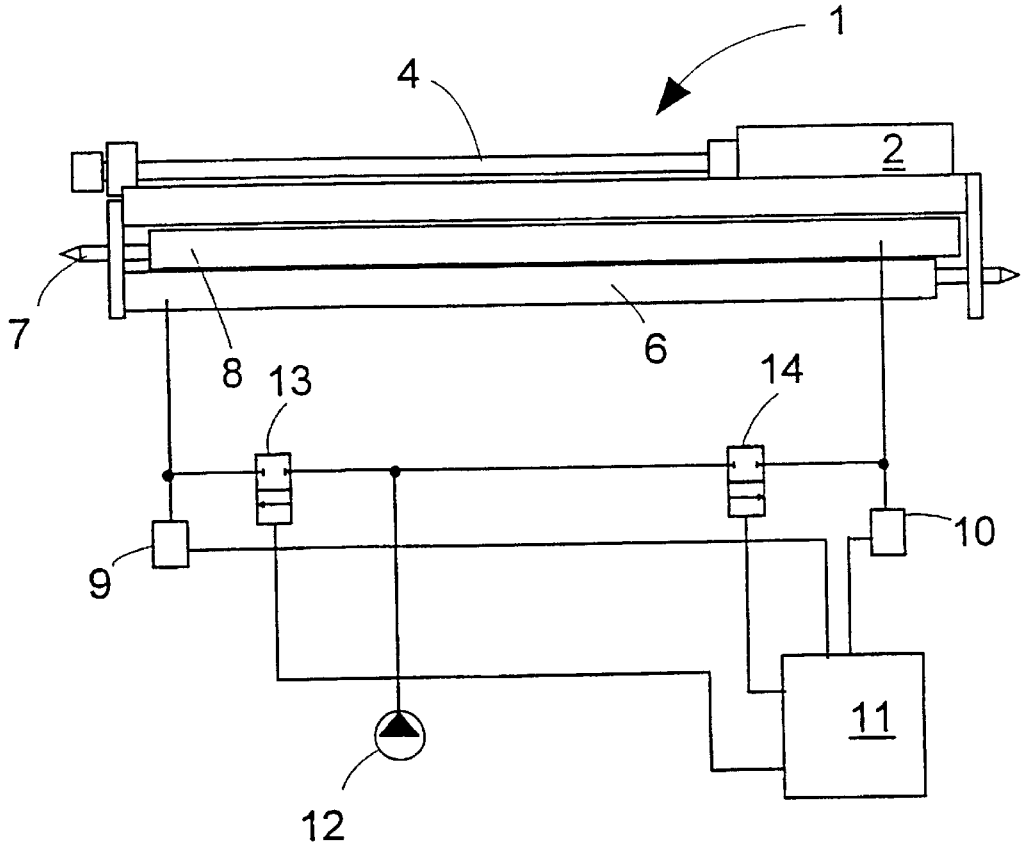

FIGS. 1*a* and 1*b* show a schematic view of a feed 1 of a rock drilling apparatus. A rock drill 2 moves lengthwise of the feed by means of feed elements, such as feed cylinders 3. To the rock drill 2 is connected a drill rod or pipe 4, at the other end of which there is a similar drill rod or pipe or a drill bit for the collaring step. This kind of extension rod drilling technique is commonly known and obvious to a person skilled in the art, and so it will not be described in greater detail in this connection.

At the rear end of the feed can be seen the tips of rear supports 5. The rear supports 5 are arranged at the ends of the piston rods of support cylinders 6 in the longitudinal direction of the feed, and they are made to support the feed by supplying pressure fluid to the cylinder 6, the pressure fluid pushing the piston rod out toward the rear end of the feed. The figures also show a front support 7, which is mounted on the piston rod of its support cylinder 8 and is pushed outward through the front end of the feed when pressure fluid is supplied to the support cylinder 8. Correspondingly, the front and rear supports can be positioned as shown in the figure, i.e. retracted by supplying pressure fluid to the support cylinders 6 and 8, to the other side of the pistons thereof. Instead of two rear supports, it is naturally possible to use one support 5 and one support cylinder 6 in a similar manner as described in connection with the front support. FIGS. 1*a* and 1*b* show two rear supports, but it is also possible to have two front supports, if so desired.

FIG. 1*b* also shows a schematic view of a first and a second pressure detector 9 and 10, which detect the pressure in support cylinder 6 on the one hand and the pressure of the pressure fluid in support cylinder 8 on the other hand. The pressure detectors 9 and 10 are arranged to control a control unit 11 that controls the supply of the pressure fluid to the support cylinders 6 and 8. The pressure value in both support cylinder 6 and support cylinder 8 of the invention is set as necessary for proper implementation of the bracing. The pressure prevailing in the cylinders 6 and 8 is measured by the pressure detectors 9 and 10, and the supply of the pressure fluid to the cylinders is conducted on the basis of the detected pressure so that the pressure in the support cylinders 6 and 8 remains substantially as originally set. Depending on the technique used, this can be performed in various ways without deviating from the basic idea of the invention. For example, using previously known electronics, a desired pressure value can be pre-set for both cylinders in the memory of the control unit 11, after which the control unit compares the pressure value given by the detectors 9 and 10 with the values stored in the memory and, if necessary, supplies pressure fluid to the support cylinders 6 and 8 of either the front or the rear or both supports so as to keep the pressure value as originally set. In this embodiment, the set pressure value can be easily changed in the middle of the drilling operation if it is considered necessary. When new pressure values have been set, the control unit 11 automatically corrects the pressure values of the pressure in the support cylinders 6 and 8 to correspond to the new set values. In another embodiment of the invention, the pressure detectors 9 and 10 can simply be pressure detectors in which a pressure value can be set in such a way that if the current pressure value exceeds the set value and/or is lower than the set value, the detectors 9 and 10 supply a certain kind of signal. In this embodiment, fixed pressure values are set in the feed cylinders 6 and 8 by adjusting the pressure detectors 9 and 10, for example, to detect when the pressure of the pressure fluid in the support cylinders 6 and 8, respectively, is at least the same as the predefined pressure value. The control unit 11 controls the supply of the pressure fluid to the support cylinders 6 and 8 when the feed is being braced: the supply of the pressure fluid to cylinder 6 and cylinders 8 is stopped when the pressure detectors 9 and 10 detect that the pressure in the cylinder has reached the predefined set value. When the drilling is started, the feed is subjected to drill forces, which may make the support surface yield. The pressure in the cylinders and particularly in the support cylinders 6 of the rear supports may then drop, whereby pressure detector 9 makes the control unit 11 control the supply of the pressure fluid to support cylinders 6 in such a way that the pressure in the cylinders remains essentially the same as the predefined set value. Pressure fluid is supplied to the system by a pressure fluid pump 12 in a manner fully known per se, and the supply of the pressure fluid to the cylinders 6 and 8 is controlled by valves 13 and 14 controlled by the control unit.

Figure 2:
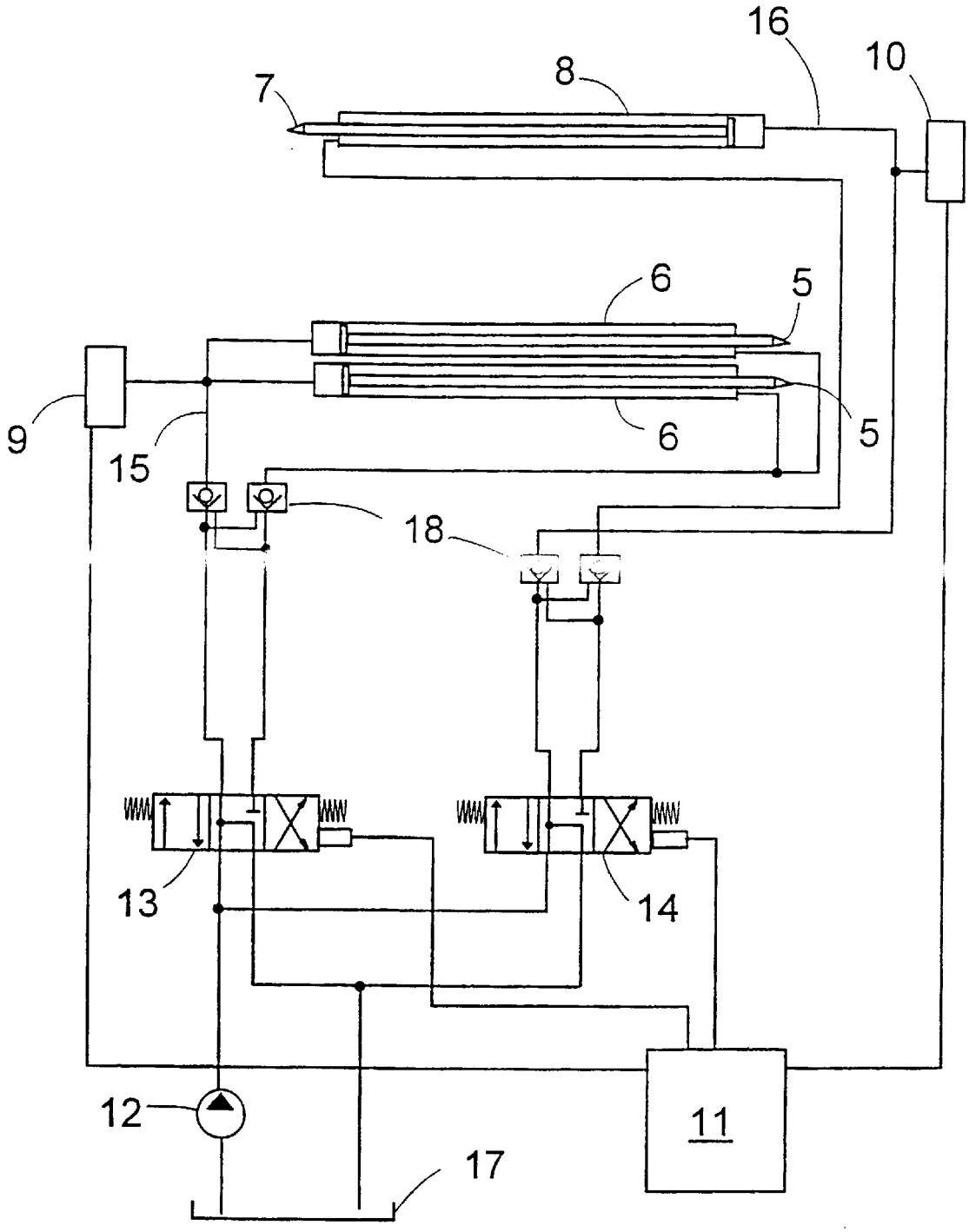
FIG. 2 shows in greater detail the functional circuitry of the arrangement according to the invention.

FIG. 2, in turn, is a schematic view illustrating the functional circuitry of the hydraulic support cylinders 6 and 8 of the front and rear supports. As shown in the figure, pressure detectors 9 and 10 are connected to the pressure fluid conduits of support cylinders 6 and 8, respectively. When the pressure in support cylinder 6, for example, drops below the set value of the first pressure detector 9, the detector supplies a signal to the control unit, which switches control valve 13 to a position in which pressure fluid can flow from the pressure fluid pump 12 through conduit 15 to cylinder 6. When the pressure in cylinders 6 reaches the set value of pressure detector 9, the pressure detector detects the situation and the control unit switches control valve 14 to a position in which the supply of pressure fluid to cylinders 6 will stop. This is repeated every time the bracing of cylinder 6 changes, for example, because the ground yields, so as to keep the pressure in cylinder 6 essentially the same as the set pressure value throughout the drilling operation.

Correspondingly, in a pressure fluid conduit 16 of support cylinder 8 of the front support 7 there is another pressure detector 10, which detects a pressure drop in a similar manner as described above and supplies a signal to the control unit concerning the supply of the pressure fluid by controlling control valve 14 so as to keep the pressure in support cylinder 8 essentially constant, at least at the pre-set pressure value. FIG. 2 also shows a pressure fluid container 17 from which the pressure liquid pump obtains pressure fluid and to which the pressure fluid returns from the cylinders. In addition, the figure shows pressure-controlled check valves 18 connected to the pressure fluid conduits of the support cylinders 6 and 8, the check valves hindering the flow of the pressure fluid from the cylinders otherwise, but allowing it when pressure fluid is supplied to either one of the conduits through valve 13 or 14. The structure and operation of the valves is commonly known per se and obvious to a person skilled in the art, and so we do not consider it necessary to describe them in greater detail herein. It is also possible to implement the invention in such a way that the pressure value of the pressure prevailing in the support cylinders 6 and/or 8 can be set by the user, although a certain minimum pressure value has been set in the memory of the control unit 11 or in the pressure detectors 9 and 10, the supporting pressure and the corresponding supporting force never being lower than this minimum pressure value. This can be implemented in various ways in accordance with the above embodiments.

The invention is described in the above description and the drawings by way of an example, and it is not to be construed as being limited by them. The essential feature is that the pressure prevailing in the support cylinders of the front and rear supports of a rock drilling apparatus is monitored and that any change of pressure that makes the pressure in the cylinder drop below a pre-set pressure value makes the control unit control the supply of the pressure fluid to the cylinders so as to essentially maintain the set value of the pressure in the cylinders. The invention can also be applied in solutions where, for example, a separate front support is not used, but where there are one or more rear supports. This is particularly useful when there are two rear supports spaced apart in the transverse direction of the feed. If the support surface yields, for example, at one of the supports, the pressure will drop in both support cylinders, and when more pressure fluid is supplied, the pressure will rise evenly in both cylinders or will remain essentially even, although one of the supports is pushed further out, until there is a sufficiently firm surface behind both supports.

What is claimed is:

1. A rock drilling apparatus to be located between a rock surface and a support surface for drilling the rock surface, the rock drilling apparatus comprising:

a rock drill, a feed for feeding the rock drill in a forward direction towards the rock surface during drilling, the feed being urged in a rearward direction opposite the forward direction during drilling, a rear support cylinder attached to the feed, at least one rear support urged by the rear support cylinder substantially parallel to the rearward direction to engage the support surface, a rear support cylinder desired value means for setting a desired value for pressure in the rear support cylinder, a rear support cylinder pressure detector for detecting the pressure in the rear support cylinder, a front support cylinder attached to the feed, at least one front support urged by the front support cylinder substantially parallel to the forward direction to engage the rock surface, a front support cylinder desired value means for setting a desired value for pressure in the front support cylinder, and a front support cylinder pressure detector for detecting the pressure in the front support cylinder, and a pressure controller responsive to the rear support cylinder pressure detector for controlling supply of pressure fluid to the rear support cylinder to maintain the pressure of fluid in the rear support cylinder substantially at the desired value set by the rear support cylinder desired value means, and wherein the pressure controller is responsive to the front support cylinder pressure detector for controlling supply of pressure fluid to the front support cylinder to maintain the pressure of fluid in the front support cylinder substantially at the desired value set by the front support cylinder desired value means.

2. A rock drilling apparatus to be located between a rock surface and a support surface for drilling the rock surface, the rock drilling apparatus comprising:

a rock drill, a feed for feeding the rock drill in a forward direction towards the rock surface during drilling, the feed being urged in a rearward direction opposite the forward direction during drilling, a plurality of support cylinders attached to the feed, each support cylinder having a pressure fluid chamber and the pressure fluid chambers of the support cylinders being interconnected, a plurality of rear supports engaged with the support cylinders respectively and urged by the respective support cylinders substantially parallel to the rearward direction to engage the support surface, a desired value means for setting a desired value for pressure in the interconnected pressure fluid chambers of the support cylinders, a pressure detector for detecting the pressure in the interconnected pressure fluid chambers of the support cylinders, and a pressure controller responsive to the pressure detector for controlling supply of pressure fluid to the support cylinders to maintain the pressure of fluid in the interconnected pressure fluid chambers of the support cylinders substantially at said desired value.

3. A rock drilling apparatus according to claim 2, further comprising:

a front support cylinder attached to the feed, at least one front support urged by the front support cylinder substantially parallel to the forward direction to engage the rock surface, a front support cylinder desired value means for setting a desired value for pressure in the front support cylinder, and a front support cylinder pressure detector for detecting the pressure in the front support cylinder, and wherein the pressure controller is responsive to the front support cylinder pressure detector for controlling supply of pressure fluid to the front support cylinder to maintain the pressure of fluid in the front support cylinder substantially at the desired value set by the front support cylinder desired value means.

* * * * *

UNITED STATES PATENT AND TRADEMARK OFFICE

CERTIFICATE OF CORRECTION

PATENT NO. : 6,213,223 B1
DATED : April 10, 2001
INVENTOR(S) : Tapani Huhdanmäki It is certified that error appears in the above-identified patent and that said Letters Patent is hereby corrected as shown below:

Title page,
Item [73], "Sandvick Tamrock Oy" should be deleted and replaced with -- Sandvik Tamrock Oy --.

Signed and Sealed this

First Day of January, 2002

*Attest:*

*Attesting Officer*

JAMES E. ROGAN
*Director of the United States Patent and Trademark Office*